US010060623B2

(12) United States Patent
Yang

(10) Patent No.: US 10,060,623 B2
(45) **Date of Patent: *Aug. 28, 2018**

(54) GAS HOT AIR GUN HEAD

(71) Applicant: Pro-Iroda Industries, Inc., Taichung (TW)

(72) Inventor: Cheng-Nan Yang, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/355,236

(22) Filed: Nov. 18, 2016

(65) Prior Publication Data

US 2017/0074511 A1 Mar. 16, 2017

Related U.S. Application Data

(63) Continuation of application No. 14/297,686, filed on Jun. 6, 2014, now Pat. No. 9,612,012, which is a continuation of application No. 14/464,735, filed on Aug. 21, 2014.

(51) Int. Cl.

| | |
|---|---|
| ***F23D 14/28*** | (2006.01) |
| ***F23D 14/38*** | (2006.01) |
| ***F23D 14/52*** | (2006.01) |
| ***F23D 14/62*** | (2006.01) |

(52) U.S. Cl.

CPC ..... *F23D 14/38* (2013.01); *F23D 14/28* (2013.01); *F23D 14/52* (2013.01); *F23D 14/62* (2013.01)

(58) Field of Classification Search

CPC ..... F23D 14/28; F23D 14/62; F23D 14/52; F23D 14/38

See application file for complete search history.

(56) References Cited

U.S. PATENT DOCUMENTS

| | | | |
|---|---|---|---|
| 4,726,767 | A | 2/1988 | Nakajima |
| 5,155,925 | A | 10/1992 | Choi |
| 7,488,171 | B2 | 2/2009 | St Charles |
| 9,182,144 | B2 | 11/2015 | Chen |
| 2004/0078992 | A1 | 4/2004 | Fujiwara |
| 2013/0230816 | A1 | 9/2013 | Chen |

FOREIGN PATENT DOCUMENTS

| | | |
|---|---|---|
| TW | I261100 B | 9/2006 |

*Primary Examiner* — Alfred Basichas
(74) *Attorney, Agent, or Firm* — Alan D. Kamrath; Kamrath IP Lawfirm, P.A.

(57) ABSTRACT

A gas hot air gun head includes a fuel supply device engagable with a gas reservoir and having a fluid inlet end, a fluid outlet end and a channel extending from the fluid inlet end to the fluid outlet end. Further, a flow-guiding device connects to the fluid outlet end of the fuel supply device and includes a combustor. The combustor connects to the fuel supply device. The combustor includes a combustion chamber extending therethrough. The combustion chamber includes first and second flow-guiding plates engaging therein and separating from each other in an axial direction. The first flow-guiding plate includes a plurality of first holes extending therethrough. The second flow-guiding plate includes a plurality of second holes extending therethrough. A centerline of one of the plurality of first holes offsets from centerlines of the plurality of second holes.

17 Claims, 6 Drawing Sheets

GAS HOT AIR GUN HEAD

CROSS REFERENCE

This present application is a continuation application of U.S. application Ser. No. 14/297,686, filed on Jun. 6, 2014, now U.S. Pat. No. 9,612,012.

BACKGROUND OF THE INVENTION

1. Field of the Invention

The present invention relates to a gas hot air gun head and, particularly, to a gas hot air gun head including a flow-guiding device and preventing combustion flames from stretching out of the flow-guiding device.

2. Description of the Related Art

TW Patent No. 1261100, entitled improved nozzle of gas hot air tool, shows an improved nozzle of a gas hot air tool including a body, a blower, an ignition device, a switch set, and a nozzle. The body includes a tube part and a stem part. The inside of the tube part is installed with a heating chamber and a mixing chamber. Furthermore, the blower and the ignition device are installed in the tube part. The inside of the stem part is installed with a gas can. The nozzle includes a plurality of nozzle holes. The switch set is turned on for the fluid in the gas can to flow into the nozzle and inject into the mixing chamber through the nozzle holes. Before entering the heating chamber, the fluid is mixed thoroughly with air to form a combustion gas in order to achieve thorough combustion in the heating chamber.

It is found that hot air discharged from the gas hot air tool flows quickly and travels in a straight line and will cause flames of a burning gas to stretch out of a hot air outlet of the gas hot air tool. Therefore, a user of the gas hot air tool can accidentally burn and damage an object. Even worse, he could suffer safety problems.

The present invention is, therefore, intended to obviate or at least alleviate the problems encountered in the prior art.

SUMMARY OF THE INVENTION

According to the present invention, a gas hot air gun head includes a fuel supply device engagable with a gas reservoir and having a fluid inlet end, a fluid outlet end and a channel extending from the fluid inlet end to the fluid outlet end. Further, a flow-guiding device connects to the fluid outlet end of the fuel supply device and includes a combustor. The combustor connects to the fuel supply device. The combustor includes a combustion chamber extending therethrough. The combustion chamber includes first and second flow-guiding plates engaging therein and separating from each other in an axial direction. The first flow-guiding plate includes a plurality of first holes extending therethrough. The second flow-guiding plate includes a plurality of second holes extending therethrough. A centerline of one of the plurality of first holes offsets from centerlines of the plurality of second holes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a gas hot air gun head that prevents combustion flames from stretching out of the flow-guiding device.

It is another objective of the present invention to provide a gas hot air gun head that includes hot air flowing therein and increases the temperature of the hot air output.

Other objectives, advantages, and new features of the present invention will become apparent from the following detailed description of the invention when considered in conjunction with the accompanied drawings.

DETAILED DESCRIPTION OF THE INVENTION

Figure 1:
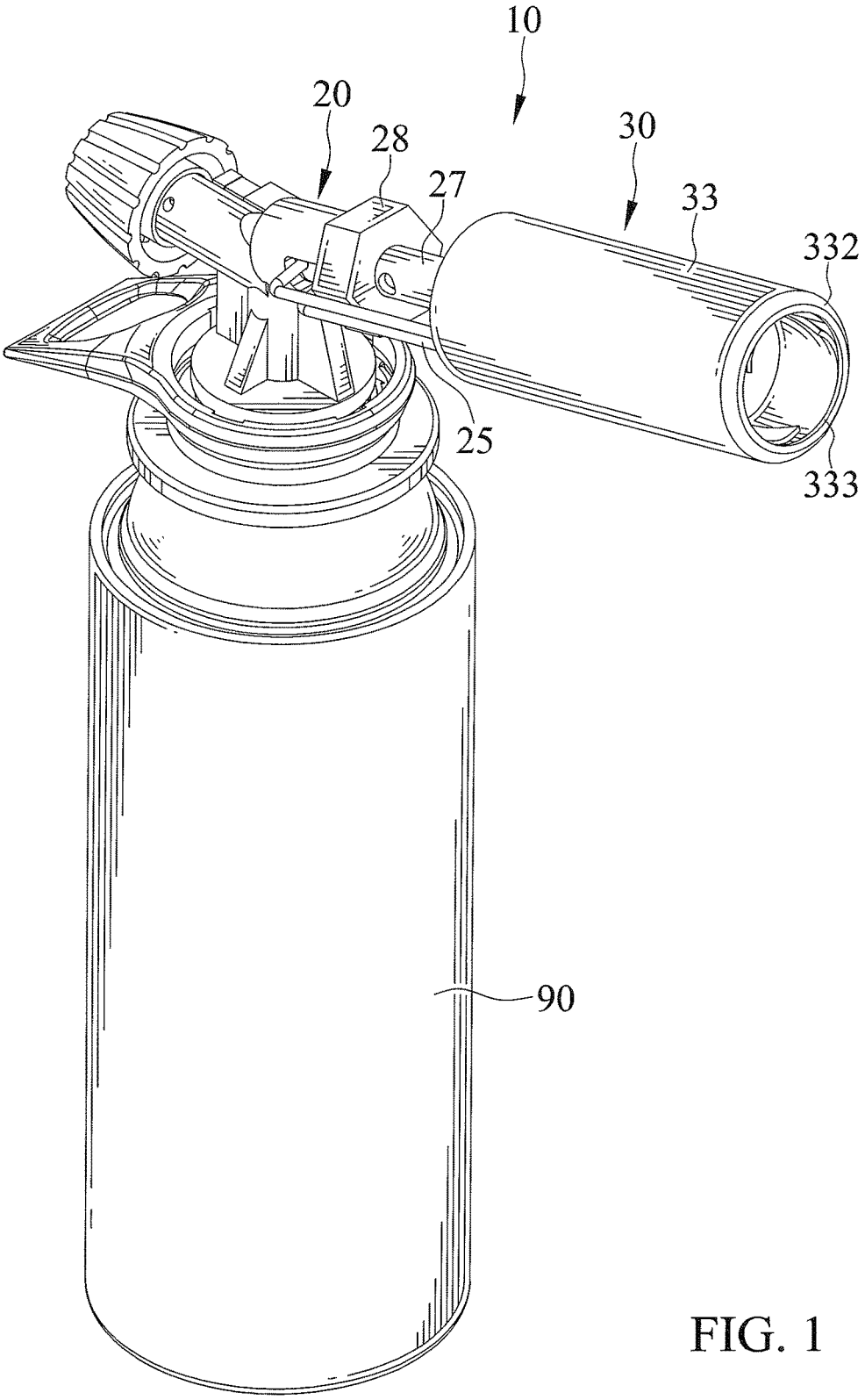
FIG. 1 is a perspective view of a gas hot air gun head in accordance with the present invention engaging with a gas reservoir.
Figure 2:
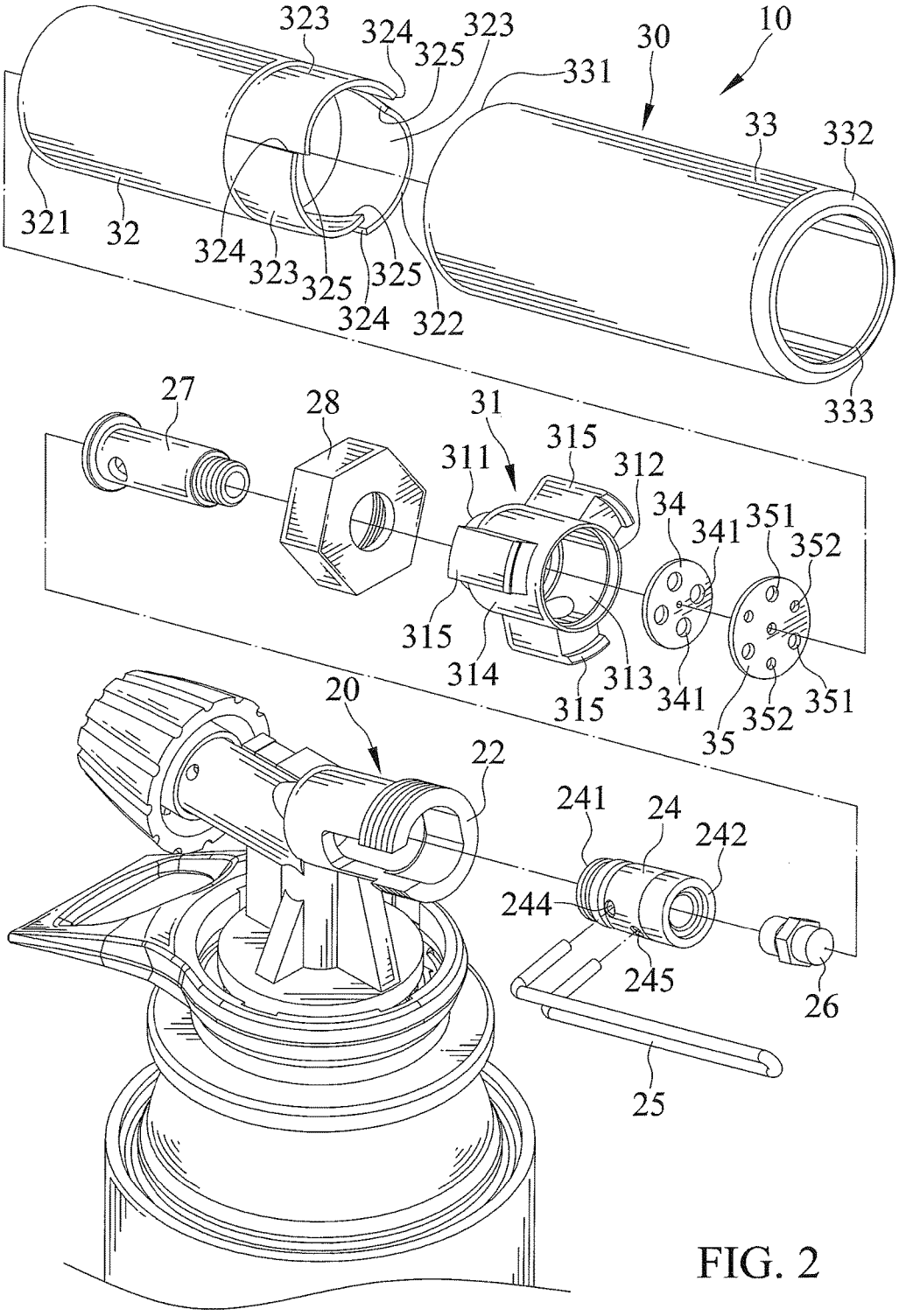
FIG. 2 is an exploded perspective view of the gas hot air gun head of FIG. 1.
Figure 3:
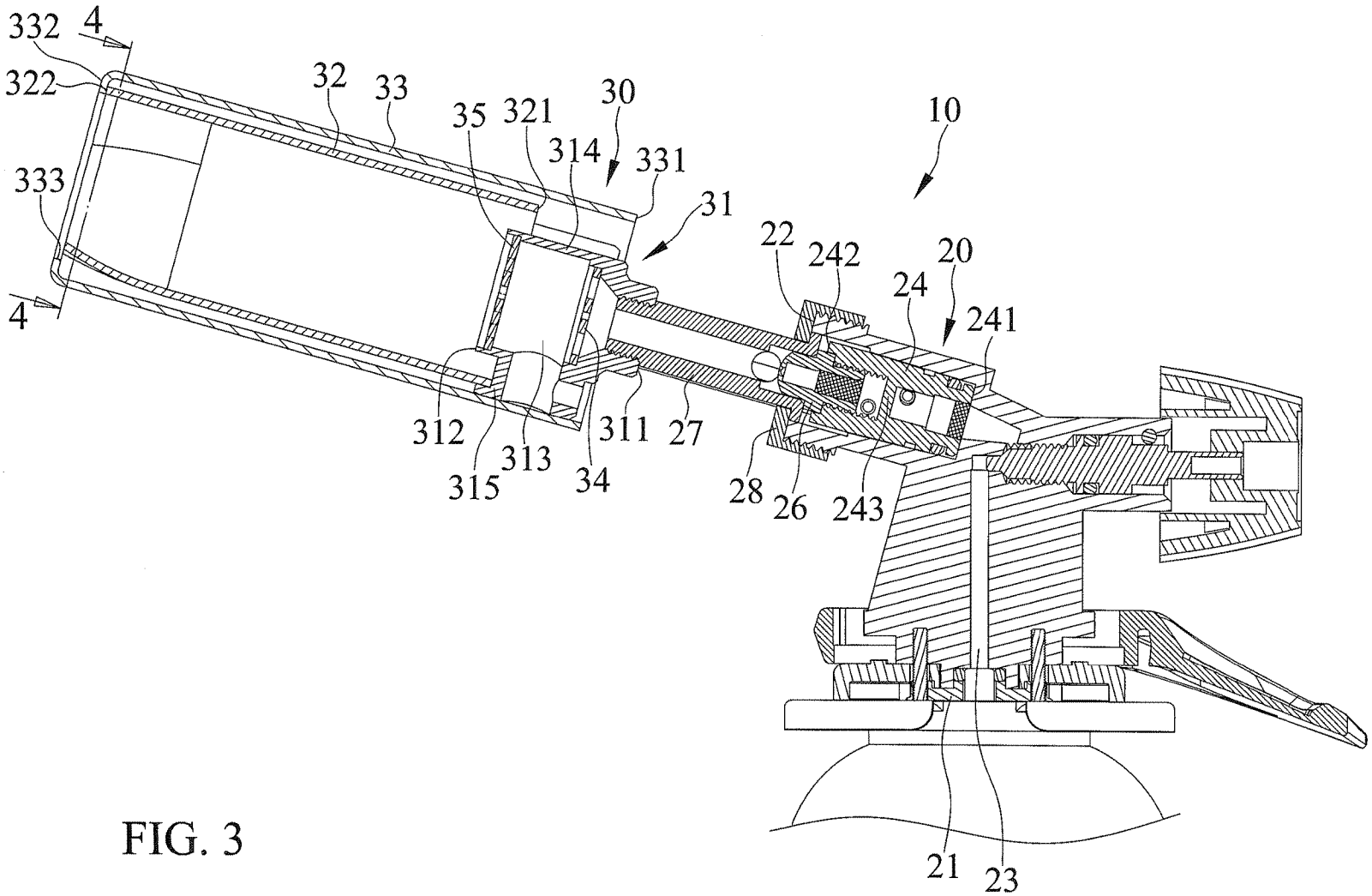
FIG. 3 is a partial, cross-sectional view of the gas hot air gun head of FIG. 1.
Figure 4:
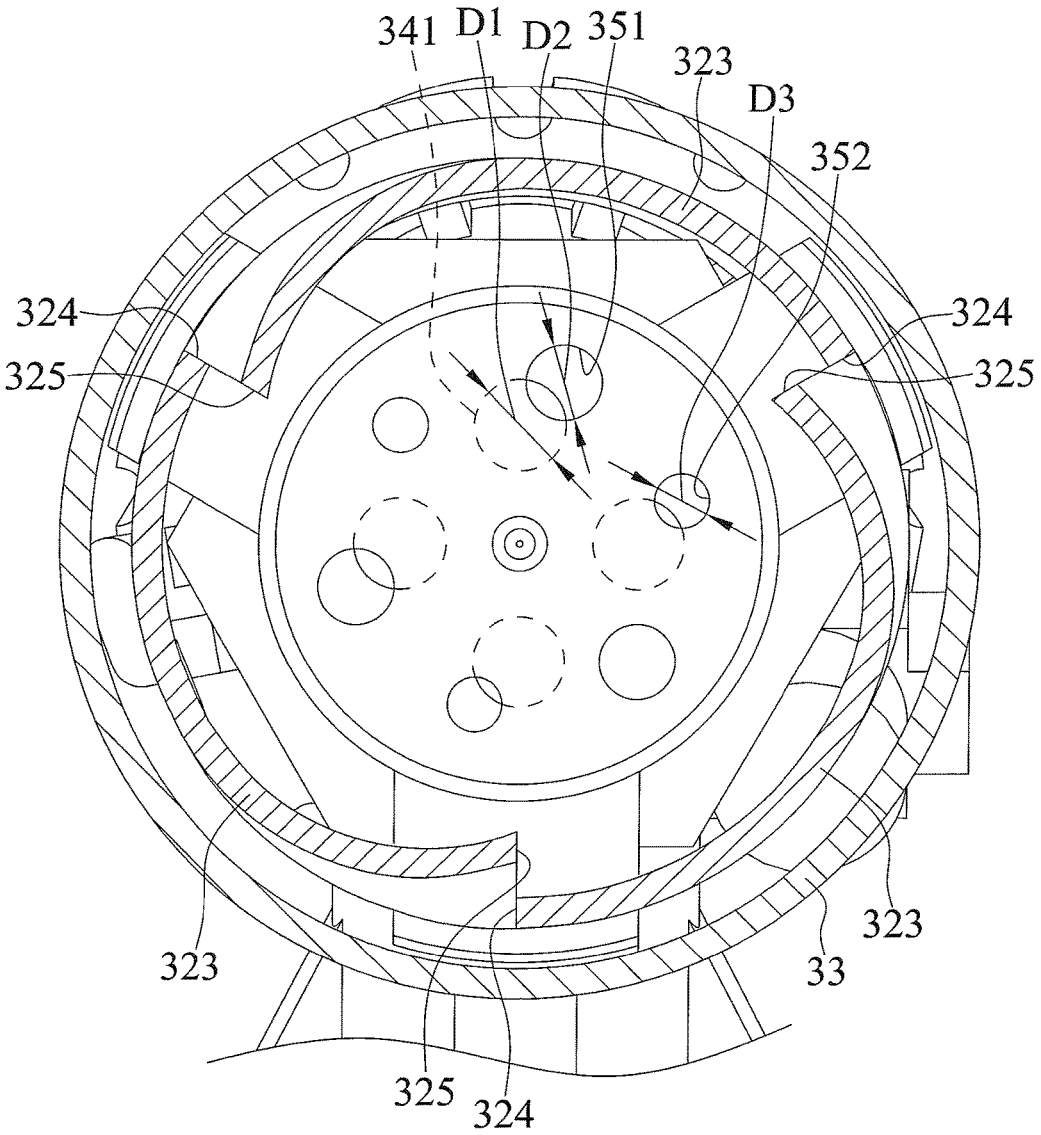
FIG. 4 is a cross-sectional view taken along line 4-4 of FIG. 3.
Figure 5:
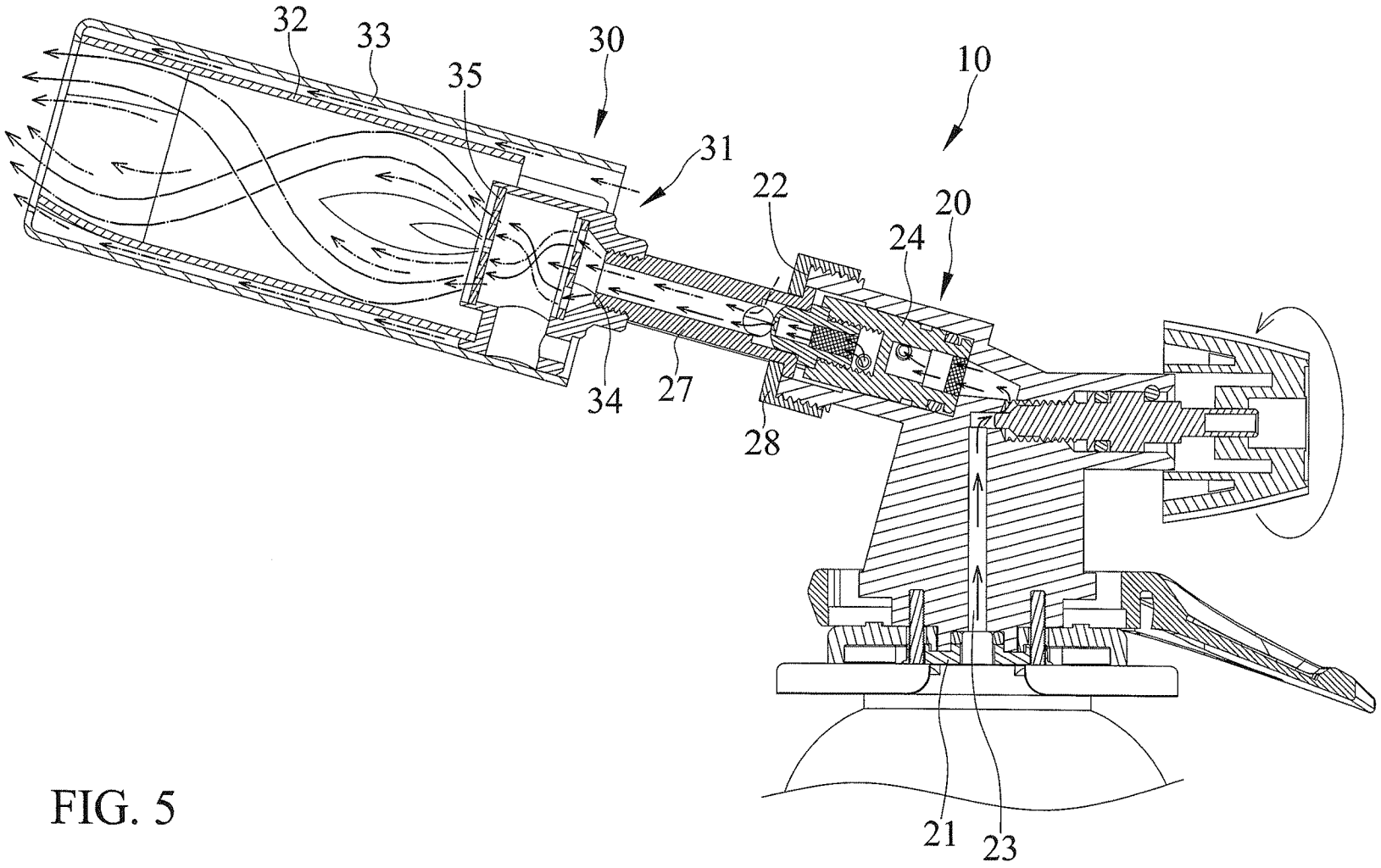
FIG. 5 is a partial, cross-sectional view showing the gas hot air gun head of FIG. 1 discharging hot air.
Figure 6:
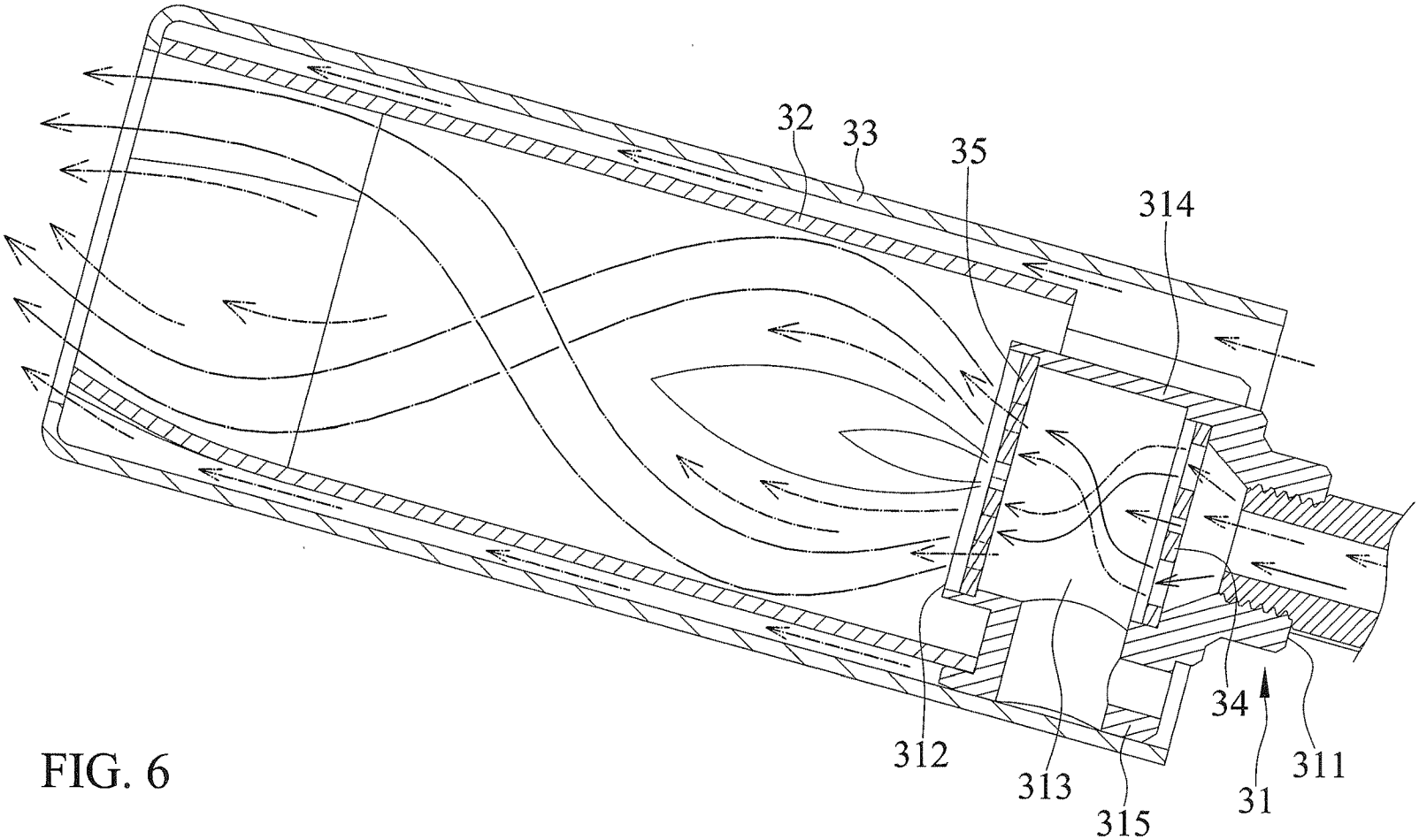
FIG. 6 is a partial, enlarged view of FIG. 5.

FIGS. 1 through 6 show a gas hot air gun including a gas hot air gun head 10 in accordance with the present invention and a gas reservoir 90 engaging with the gas hot air gun head 10.

The gas hot air gun head 10 includes a fuel supply device 20 engagable with the gas reservoir 90. The fuel supply device 20 has a fluid inlet end 21, a fluid outlet end 22 and a channel 23 extending from the fluid inlet end 21 to the fluid outlet end 22. The gas hot air gun head 10 engages with the gas reservoir 90 by engaging the fuel supply device 20 with the gas reservoir 90. The gas hot air gun head 10 can draw fuel in the gas reservoir 90 by the fuel supply device 20. The fuel supply device 20 has a controller which controls the flow output rate of fuel in the gas reservoir 90. The controller can be changed to a position in which fuel in the gas reservoir 90 is stopped from flowing into the fuel supply device 20. The fuel supply device 20 includes a plug 24 disposed in the channel 23. The plug 24 has a first end 241 and a second end 242 opposite the first end 241 and includes a partition 243 separating and blocking connection of the first and second ends 241 and 242. The plug 24 includes first and second orifices 244 and 245 receiving two ends of a preheater 25. The preheater 25 is disposed outside the plug 24. The preheater 25 interconnects the first and second ends 241 and 242 of the plug 24. The first orifice 244 is disposed adjacent to the first end 241. The second orifice 245 is disposed adjacent to the second end 242. The second end 242 of the plug 24 is adjacent to the fluid outlet end 22. The preheater 25 has a tubular structure. The preheater 25 extends in a direction away from the fluid inlet end 21. Further, a spray head 26 engages with the second end 242 of the plug 24.

The gas hot air gun head 10 includes a flow-guiding device 30 connecting to the fuel supply device 20. The fuel supply device 20 includes an extension tube 27 interconnecting the fuel supply device 20 and the flow-guiding device 30. The flow-guiding device 30 connects to the fluid outlet end 22 of the fuel supply device 20. The gas hot air gun head 10 draws fuel in the gas reservoir 90 to the flow-guiding device 30 by the fuel supply device 20. In that regard, the fuel flows out of the gas reservoir 90, enters the fuel supply device 20 through the fluid inlet end 21, travels in the channel 23, leaves the fuel supply device 20 through the fluid outlet end 22, and enters the flow-guiding device 30. The flow-guiding device 30 includes a combustor 31, an inner barrel 32 and an outer barrel 33 enclosing the inner barrel 32.

Combustion of the gas hot air gun happens in the combustor 31. The combustor 31 connects to the fuel supply device 20. The combustor 31 has a first end 311 and a second end 312 opposite the first end 311. The combustor 31 includes the first end 311 engaging with one of two opposite ends of the extension tube 27. The extension tube 27 has the other of two opposite ends fitted to the fluid outlet end 22. The extension tube 27 and the combustor 31 are in thread engagement. In addition, a retainer 28 retains the extension tube 27 to the fluid outlet end 22, with the retainer 28 secured to the fluid outlet end 22 and including an edge blocking and abutting against a peripheral edge of the extension tube 27. The retainer 28 and the fluid outlet end 22 are in thread engagement. Furthermore, the spray head 26 has an end inserted into and in fluid communication with a hollow of the extension tube 27. The combustor 31 includes a combustion chamber 313 extending therethrough. The combustion chamber 313 extends through the first and second ends 311 and 312 of the combustor 31. The combustion chamber 313 includes first and second flow-guiding plates 34 and 35 engaging therein and separating from each other in an axial direction. The first flow-guiding plate 34 is disposed adjacent to the first end 311 of the combustor 31. The second flow-guiding plate 35 is disposed adjacent to the second end 312 of the combustor 31. The combustion chamber 313 has an inner periphery and each of the first and second flow-guiding plates 34 and 35 includes a peripheral edge thereof abutting against the inner periphery, with no gap between the inner periphery and the peripheral edge of the first flow-guiding plate, and with no gap between the inner periphery and the peripheral edge of the second flow-guiding plate. The first flow-guiding plate 34 includes a plurality of first holes 341 extending therethrough. The second flow-guiding plate 35 includes a plurality of second holes 351 extending therethrough. Hot air in the combustion chamber 313 passes the first flow-guiding plate 34 through the plurality of first holes 341. Moreover, hot air in the combustion chamber 313 passes the second flow-guiding plate 35 through the plurality of second holes 351. A centerline of one of the plurality of first holes 341 offsets from centerlines of the plurality of second holes 351. The centerline of one of the plurality of first holes 341 is in a non-coaxial relationship with the centerlines of any of the plurality of second holes 351. Each of the plurality of first holes 341 has a first diameter D1. Each of the plurality of second holes has a second diameter D2. The first diameter D1 is not equal to the second diameter D2. The second diameter D2 is shorter than the first diameter D1. Moreover, the second flow-guiding plate 35 has a plurality of third holes 352 extending therethrough. Hot air in the combustion chamber 313 passes the second flow-guiding plate 35 through the plurality of third holes 352. A centerline of one of the plurality of third holes 352 offsets from centerlines of the plurality of first holes 341. The plurality of second and third holes 351 and 352 are alternatively disposed. The plurality of second and third holes 351 and 352 are disposed radially with respect to a center of the second flow-guiding plate 35. Each of the plurality of third holes 352 has a third diameter D3. The third diameter D3 is shorter than the second diameter D2. Each of the plurality of first, second and third holes 341, 351, and 352 is of circular shape. The number of the plurality of second holes 351 is less than the number of the plurality of first holes 341. There are four first holes 341. There are three second holes 351. The number of plurality of second holes 351 equals to the number of plurality of third holes 352. Hot air flows through the first and second flow-guiding plates 34 and 35 will spin. The combustor 31 includes an annular outer peripheral wall 314 and at least one flange 315 protruding from and disposed outside the outer peripheral wall 314. There are three flanges 315. The three flanges 315 are separately from each other. The inner barrel 32 has a first end 321 connecting to the combustor 31, with the at least one flange 315 attaching and abutting against the first end 321 of the inner barrel 32. The outer barrel 33 has a first end 331 connecting to and enclosing the combustor 31, with the at least one flange 315 attaching and abutting against the first end of the outer barrel 33. The at least one flange 315 includes a first extension protruding radially from the outer peripheral wall 314 of the combustor 31 and a second extension protruding from the first extension. The second extension of the at least one flange 315 has a free end and is disposed above the outer peripheral wall 314 of the combustor 31. The combustor 31 secures to the inner barrel 32 by the at least one flange 315. The at least one flange 315 includes the second extension thereof tightly fitting to the inner barrel 32, with the second extension including an inner edge abutting against an outer peripheral wall of the inner barrel 32. The at least one flange 315 includes the first and second extensions thereof tightly fitting to the outer barrel 33, with the first extension including an edge abutting against an inner peripheral wall of the outer barrel 33, and with the second extension including an outer edge abutting against the inner peripheral wall of the outer barrel 33. The flanges 315 can enhance the structural strength of the combustor 31.

The inner barrel 32 has a first end 321 and a second end 322 opposite the first end 321. The inner barrel 32 includes the first end 321 thereof connecting to the second end 312 of the combustor 31. The outer barrel 33 has a first end 331 and a second end 332 opposite the first end 331. The combustor 31 is disposed within the first end 331 of the outer barrel 33.

The inner barrel 32 is radially spaced from the outer barrel 33. The ends 321, 322, 331, and 332 of the inner and outer barrels 32 and 33 are open. Ambient air can flow into a space between and cool the temperature of the inner and outer barrels 32 and 33. Ambient air can flow into the inner and outer barrels 32 and 33 and cools the combustor 31, thereby improving the combustion efficiency. Hot air is discharged from the gas hot air gun head 10 through the second end 322 of the inner barrel 32.

Furthermore, the inner barrel 32 includes the second end 322 including a plurality of annular fins 323. The plurality of annular fins 323 help hot air maintain spinning after being discharged from the second end 322 of the inner barrel 32. The plurality of annular fins 323 is disposed radially with respect to a center of the inner barrel 32. The plurality of annular fins 323 is disposed adjacent to each other in a circumferential direction of the inner barrel 32. Each of the plurality of annular fins 323 includes a first lateral edge 324 and a second lateral edge 325 and has a circumferential dimension measuring from the first lateral edge 324 to the second lateral edge 325. The first and second lateral edges 324 and 325 of each of the plurality of annular fins 323 are radially spaced from the center of the inner barrel 32 with first and second radial distances respectively. The second radial distance is shorter than the first radial distance. The outer barrel 33 includes the second end 332 including a stop edge 333 blocking and abutting against the inner barrel 32, with the first lateral edges 324 of the plurality of annular fins abutting against the stop edge. The inner barrel 32 is therefore securely disposed within the outer barrel 33. The plurality of annular fins 323 and the inner barrel 32 are made out of a material. The plurality of annular fins 323 is bent from the second end 322 of inner barrel 32.

In view of the forgoing, the flow-guiding device 30 will cause hot air flowing therein to spin, such that the flow-guiding device 30 will include a spinning vortex of hot air flowing therein and the gas hot air gun head 10 will discharge the spinning vortex of hot air. The flow-guiding device 30 prevents combustion flames from stretching out of the gas hot air gun, or the combustion flames are prevented from stretching out of the flow-guiding device 30. The temperature of the hot air is increased. Ambient air can flow into the space and cool the temperature of inner and outer barrels 32 and 33. Ambient air can flow into the inner and outer barrels 32 and 33 and cools the combustor 31, thereby improving the combustion efficiency.

The foregoing is merely illustrative of the principles of this invention, and various modifications can be made by those skilled in the art without departing from the scope and spirit of the invention.

What is claimed is:

1. A gas hot air gun head comprising:

a fuel supply device engagable with a gas reservoir and having a fluid inlet end, a fluid outlet end and a channel extending from the fluid inlet end to the fluid outlet end; and a flow-guiding device connecting to the fluid outlet end of the fuel supply device and including a combustor, with the combustor connecting to the fuel supply device, with the combustor including a combustion chamber extending therethrough, with the combustion chamber including first and second flow-guiding plates engaging therein and separating from each other in an axial direction, with the first flow-guiding plate including a plurality of first holes extending therethrough, with the second flow-guiding plate including a plurality of second holes extending therethrough, and with centerlines of the plurality of first holes offsetting from centerlines of the plurality of second holes;

wherein the combustion chamber has an inner periphery and each of the first and second flow-guiding plates includes a peripheral edge thereof abutting against the inner periphery, with no gap between the inner periphery and the peripheral edge of the first flow-guiding plate, and with no gap between the inner periphery and the peripheral edge of the second flow-guiding plate.

2. The gas hot air gun head as claimed in claim 1, wherein each of the plurality of first holes has a first diameter, wherein each of the plurality of second holes has a second diameter, wherein the second diameter is not equal to the first diameter.

3. The gas hot air gun head as claimed in claim 2, wherein the second diameter is shorter than the first diameter.

4. The gas hot air gun head as claimed in claim 3, wherein the second flow-guiding plate has a plurality of third holes extending therethrough, wherein centerlines of the plurality of third holes are offset from centerlines of the plurality of first holes, wherein the pluralities of second and third holes are disposed alternatively and radially with respect to a center of the second flow-guiding plate, wherein each of the plurality of third holes has a third diameter, and wherein the third diameter is not equal to the second diameter.

5. The gas hot air gun head as claimed in claim 4, wherein the number of the plurality of second holes is less than the number of the plurality of first holes, and wherein the number of plurality of second holes equals to the number of plurality of third holes.

6. The gas hot air gun head as claimed in claim 5, wherein the third diameter is shorter than the second diameter.

7. The gas hot air gun head as claimed in claim 1, wherein the flow-guiding device includes an inner barrel and an outer barrel enclosing the inner barrel, wherein the inner barrel is radially spaced from the outer barrel, wherein each of the inner and outer barrels has two opposite open ends, and wherein the inner and outer barrels have first ends connecting to the combustor.

8. The gas hot air gun head as claimed in claim 7, wherein the inner barrel has a second end including a plurality of annular fins, with the plurality of annular fins disposed radially with respect to a center of the inner barrel, and with the plurality of annular fins disposed adjacent to each other in a circumferential direction of the inner barrel, wherein each of the plurality of annular fins includes a first lateral edge and a second lateral edge and has a circumferential dimension measuring from the first lateral edge to the second lateral edge, wherein the first and second lateral edges of each of the plurality of annular fins are radially spaced from the center of the inner barrel with first and second radial distances respectively, wherein the second radial distance is shorter than the first radial distance, and wherein the outer barrel has a second end including a stop edge blocking and abutting against the inner barrel, with the first lateral edges of the plurality of annular fins abutting against the stop edge.

9. The gas hot air gun head as claimed in claim 8, wherein the plurality of annular fins and the inner barrel are made out of a material, and wherein the plurality of annular fins are bent from the second end of inner barrel.

10. The gas hot air gun head as claimed in claim 8, wherein the combustor includes an annular outer peripheral wall and at least one flange protruding from and disposed outside the outer peripheral wall, wherein the at least one flange attaches and abuts against the first end of the inner barrel and the first end of the outer barrel.

11. The gas hot air gun head as claimed in claim 8, wherein the fuel supply device includes a plug disposed in the channel, wherein the plug has a first end and a second end opposite the first end and includes a partition separating and blocking connection of the first and second ends, wherein the plug includes first and second orifices receiving two ends of a preheater, wherein the preheater is disposed outside the plug, and wherein the preheater interconnects the first and second ends of the plug.

12. The gas hot air gun head as claimed in claim 11, wherein the preheater has a tubular structure.

13. The gas hot air gun head as claimed in claim 12, wherein the preheater extends in a direction away from the fluid inlet end.

14. The gas hot air gun head as claimed in claim 11 further comprising a spray head engaging with the second end of the plug.

15. The gas hot air gun head as claimed in claim 14, wherein the fuel supply device includes an extension tube in fluid communication with the spray head, and wherein the combustor has an end engaging with one of two opposite ends of the extension tube.

16. The gas hot air gun head as claimed in claim 15 further comprising a retainer retaining the extension tube to the fluid outlet end, with the retainer secured to the fluid outlet end and including an edge blocking and abutting against a peripheral edge of the extension tube.

17. The gas hot air gun head as claimed in claim 1, wherein each of the first and second flow-guiding plates is located in the inner periphery of the combustion chamber and has the peripheral edge thereof abutting against and retained on a complete circumference of the inner periphery of the combustion chamber.

* * * * *